US009704463B2

(12) United States Patent
Moriyama

(10) Patent No.: US 9,704,463 B2
(45) Date of Patent: Jul. 11, 2017

(54) MUSICAL SOUND CONTROL APPARATUS, ELECTRIC MUSICAL INSTRUMENT, MUSICAL SOUND CONTROL METHOD, AND PROGRAM STORAGE MEDIUM

(71) Applicant: CASIO COMPUTER CO., LTD., Shibuya-ku, Tokyo (JP)

(72) Inventor: Osamu Moriyama, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/797,986

(22) Filed: Jul. 13, 2015

(65) Prior Publication Data

US 2016/0019875 A1 Jan. 21, 2016

(30) Foreign Application Priority Data

Jul. 16, 2014 (JP) ..... 2014-146046

(51) Int. Cl.

| | |
|---|---|
| ***G10H 1/00*** | (2006.01) |
| ***G10H 1/02*** | (2006.01) |
| ***G10H 1/06*** | (2006.01) |
| ***G10H 1/46*** | (2006.01) |
| ***G10H 7/00*** | (2006.01) |

(52) U.S. Cl.

CPC ..... *G10H 1/0008* (2013.01); *G10H 1/00* (2013.01); *G10H 1/0091* (2013.01); *G10H 1/02* (2013.01); *G10H 1/46* (2013.01); *G10H 7/004* (2013.01)

(58) Field of Classification Search

CPC ..... G10H 1/00; G10H 1/0091; G10H 1/0008; G10H 1/46

USPC ..... 84/602

See application file for complete search history.

(56) References Cited

U.S. PATENT DOCUMENTS 4,291,604 A * 9/1981 Scott ..... G10H 5/002 84/672
4,915,007 A * 4/1990 Wachi ..... G10H 1/06 84/477 R
5,403,970 A * 4/1995 Aoki ..... G10H 1/055 84/626

(Continued)

FOREIGN PATENT DOCUMENTS

JP 03126074 A 5/1991
JP 2004212763 A 7/2004
JP 2006276665 A 10/2006

*Primary Examiner* — David Warren
*Assistant Examiner* — Christina Schreiber
(74) *Attorney, Agent, or Firm* — Holtz, Holtz & Volek PC

(57) ABSTRACT

A musical sound control apparatus includes: an operator which as an index portion and changes values of a plurality of kinds of parameters by moving a position of the index portion; and a parameter control unit which executes processing of changing the values of the plurality of kinds of parameters according to an operated position as a position at which the index portion was moved from a standard position by an operation and processing of, when changing an assignment to the operator from a first parameter among the plurality of kinds of parameters to a second parameter among the plurality of kinds of parameters in a state in which the index portion is positioned at a position other than the standard position, setting a value of the second parameter assigned to a value which does not correspond to the position of the index portion.

14 Claims, 5 Drawing Sheets

(56) References Cited

U.S. PATENT DOCUMENTS 5,525,142 A * 6/1996 Yamauchi ..... G10H 1/0008 84/477 R
5,559,301 A * 9/1996 Bryan, Jr. ..... G10H 1/0008 345/173
5,866,834 A * 2/1999 Burke ..... G10H 1/46 84/622
6,839,441 B1 * 1/2005 Powers ..... H04H 60/04 381/119
9,196,236 B1 * 11/2015 Buese ..... G10H 1/0066
2002/0118848 A1 * 8/2002 Karpenstein ..... H04H 60/04 381/119
2004/0172144 A1 * 9/2004 Suyama ..... H04H 60/04 700/52
2005/0092163 A1 * 5/2005 Aiso ..... G10H 1/46 84/625
2006/0015198 A1 * 1/2006 Okabayashi ..... G10H 1/0091 700/94
2007/0270986 A1 * 11/2007 Mizoguchi ..... G11B 19/02 700/94
2007/0279400 A1 * 12/2007 Iwamura ..... G06F 3/03 345/184
2008/0013756 A1 * 1/2008 Roman ..... G11B 19/022 381/119
2008/0069382 A1 * 3/2008 Terada ..... G10H 1/46 381/119
2010/0013613 A1 * 1/2010 Weston ..... G06F 3/041 340/407.2
2010/0024628 A1 * 2/2010 Maruyama ..... G10H 1/0091 84/615
2012/0030626 A1 * 2/2012 Hopkins ..... G06F 3/04847 715/833
2013/0076542 A1 * 3/2013 Tanaka ..... H03K 17/9647 341/22
2013/0087037 A1 * 4/2013 Dreher ..... G10H 1/0066 84/645
2014/0193004 A1 * 7/2014 Shirai ..... H04H 60/04 381/123
2014/0205113 A1 * 7/2014 Slipp ..... G10H 7/008 381/119
2014/0214189 A1 * 7/2014 Goodwin ..... H04H 60/04 700/94
2014/0254834 A1 * 9/2014 Umeo ..... H04R 5/04 381/119
2014/0266252 A1 * 9/2014 Niwa ..... G01B 7/14 324/661
2015/0029145 A1 * 1/2015 Hlatky ..... G06F 3/041 345/174
2016/0019024 A1 * 1/2016 Suzuki ..... G10H 1/0025 700/94
2016/0019875 A1 * 1/2016 Moriyama ..... G10H 1/0091 84/602
2016/0086589 A1 * 3/2016 Moriyama ..... G10H 1/0066 84/602

* cited by examiner

MUSICAL SOUND CONTROL APPARATUS, ELECTRIC MUSICAL INSTRUMENT, MUSICAL SOUND CONTROL METHOD, AND PROGRAM STORAGE MEDIUM

This application is based upon and claims the benefit of priority from the prior Japanese Patent Application No. 2014-146046, filed Jul. 16, 2014, and the entire contents of which are incorporated herein by reference.

BACKGROUND OF THE INVENTION

Field of the Invention

The present invention relates to a musical sound control apparatus, an electric musical instrument, a musical sound control method, and a program storage medium.

Related Art

Conventionally, musical sound control apparatuses such as a synthesizer and a mixer have been known which can adjust the parameters used by way of operators such as a slider and a rotation volume.

In addition, there is also a musical sound control apparatus which can adjust a plurality of kinds of parameters by a common operator.

For example, Japanese Unexamined Patent Application, Publication No. H03-126074 discloses a parameter editing apparatus which assigns a parameter of a kind selected from among a plurality of kinds of parameters displayed to an operator at which an operation was detected, and changes a value of the parameter of the kind assigned.

SUMMARY OF THE INVENTION

However, in a case of adjusting a parameter by way of an operator having a polarity (i.e. a rotation operator having a limitation in the angle of rotation or an operator such as a slider), the value of the parameter is set to a value indicated within a range in which the operator can be moved. For this reason, a situation can occur in which, upon switching a parameter assigned to an operator, a setting value of a parameter (for example, volume level) abruptly changes to the value indicated by the operator.

It should be noted here that an operator having no polarity (for example, an operator equipped with a rotary encoder that can rotate unlimitedly) cannot be employed readily due to cost of implementation being high.

In other words, in the conventional technologies, it has been difficult to realize a function to appropriately operate a plurality of kinds of parameters by way of a common operator at low cost.

The present invention was made to address such a situation, and it is an object of the present invention to realize a function to appropriately operate a plurality of kinds of parameters by way of a common operator at low cost.

In order to achieve the abovementioned object, a musical sound control apparatus according to one aspect of the present invention includes:

an operator which has an index portion and changes a selected value among values of a plurality of kinds of parameters by moving a position of the index portion; and a parameter control unit which executes processing of changing the values of the plurality of kinds of parameters according to an operated position as a position to which the index portion was moved from a standard position, and processing of setting a value of the second parameter assigned to a value which does not correspond to the position of the index portion, when changing an assignment to the operator from a first parameter among the plurality of kinds of parameters to a second parameter among the plurality of kinds of parameters in a state in which the index portion is positioned at a position other than the standard position.

DETAILED DESCRIPTION OF THE INVENTION

In the following, embodiments of the present invention are described with reference to the drawings.

Configuration

Figure 1:
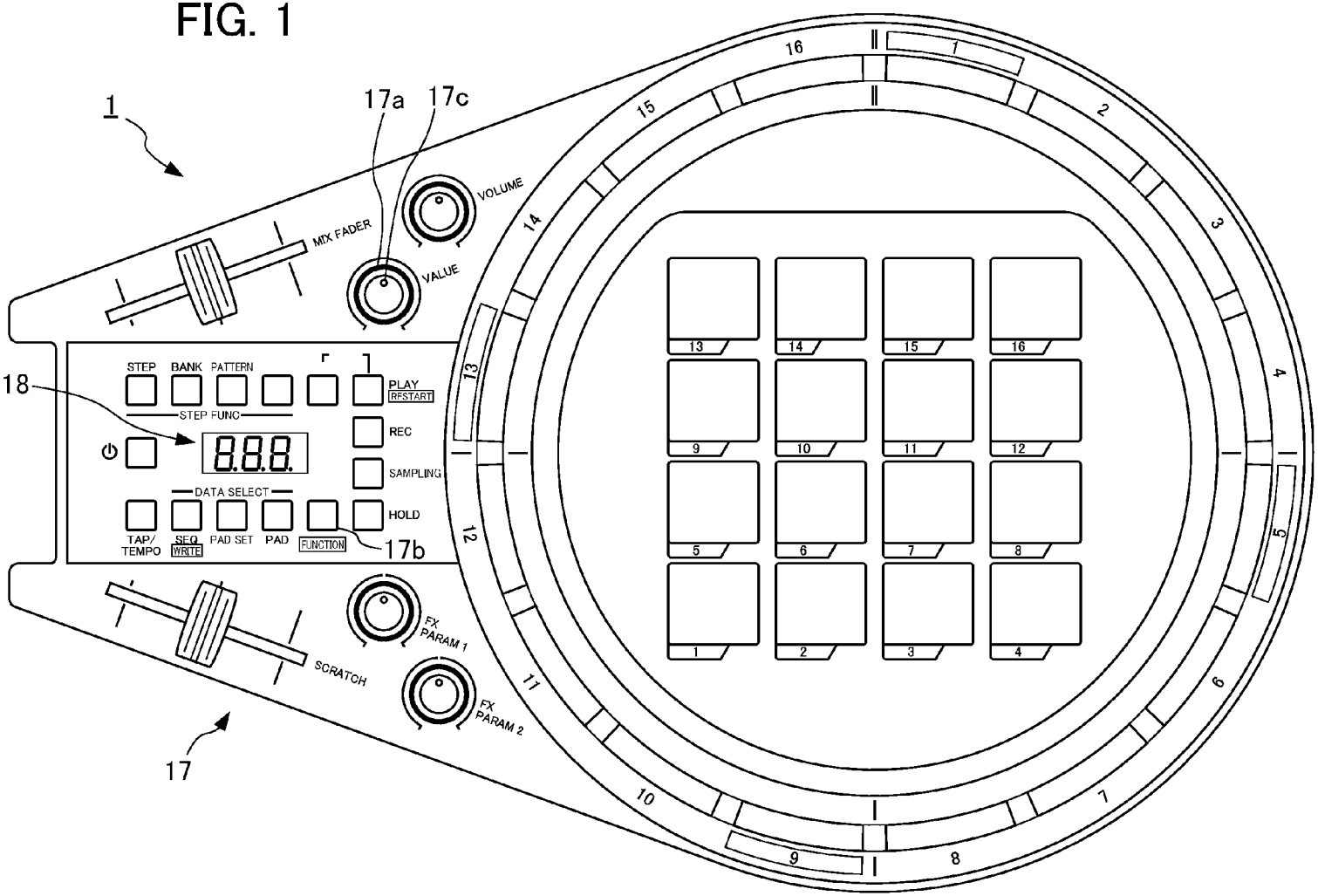
FIG. 1 is a schematic view illustrating an outer appearance of a configuration of a musical sound control apparatus according to an embodiment of the present invention.

FIG. 1 is a schematic view illustrating an outer appearance of a configuration of a musical sound control apparatus 1 according to an embodiment of the present invention.

Figure 2:
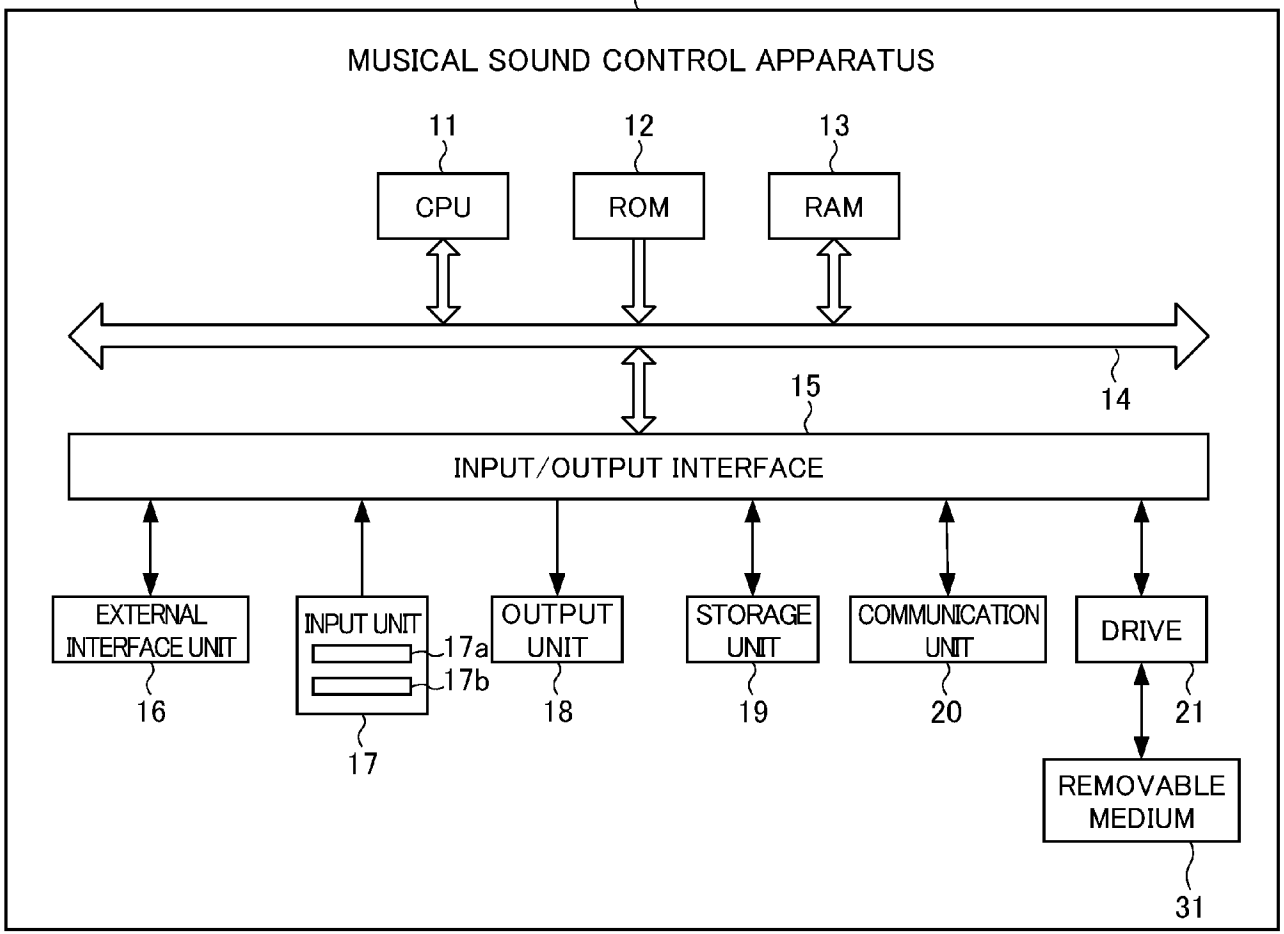
FIG. 2 is a block diagram illustrating a hardware configuration of the musical sound control apparatus according to an embodiment of the present invention.

FIG. 2 is a block diagram illustrating a hardware configuration of the musical sound control apparatus 1 according to an embodiment of the present invention.

The musical sound control apparatus 1 is an electric device in which functions of a so-called turntable or a DJ mixer that performs scratching or adding effect to music, for example, are realized by way of electronic processing.

In FIGS. 1 and 2, the musical sound control apparatus 1 includes a CPU (Central Processing Unit) 11 as a parameter control unit, ROM (Read Only Memory) 12, RAM (Random Access Memory) 13, a bus 14, an input/output interface 15, an external interface unit 16, an input unit 17, an output unit 18, a storage unit 19, a communication unit 20, and a drive 21.

The CPU 11 executes various kinds of processing according to programs stored in the ROM 12 or programs loaded from the storage unit 19 into the RAM 13.

The RAM 13 appropriately stores data that is necessary for the CPU 11 to execute various kinds of processing.

The CPU 11, the ROM 12, and the RAM 13 are connected to each other via the bus 14. To this bus 14 is also connected the input/output interface 15. To the input/output interface 15 is connected the external interface unit 16, the input unit 17, the output unit 18, the storage unit 19, the communication unit 20, and the drive 21.

The external interface unit 16 includes an input/output port such as USB (Universal Serial Bus) and MIDI (Musical Instrument Digital Interface), and controls the input and output of signals via an external apparatus.

The input unit 17 is configured with rotation operators (knob), sliders, buttons, a pad, etc., and inputs various kinds of information according to a user's instructions by operations. More specifically, as illustrated in FIG. 1, the input unit 17 includes rotation operators 17*a* for setting various parameters such as intensity or a kind of effect and selection buttons 17*b* for selecting a parameter assigned to the rotation operator 17*a*.

The rotation operator 17*a* is configured with a rotation operator having a polarity and has an upper limit and a lower limit of a rotation range. In other words, the rotation operator 17*a* can be moved within a predetermined operation range. For this operation range, it is possible to set a standard position such as a center position. Furthermore, the rotation operator 17*a* includes an index portion 17*c*. The value of a parameter changes according to the position of this index portion 17*c* (a moving amount from the standard position). It should be noted that this index portion 17*c* may be printed as a mark at the rotation operator 17*a*, may be formed as a protruding portion, or may be located inside the rotation operator 17*a*. Furthermore, the rotation operator 17*a* receives an operation for adjusting a parameter assigned. When an operation to the rotation operator 17*a* is performed, the position of the index portion 17*c* of the rotation operator 17*a* (angle of rotation from the standard position such as a center position, etc.) is input to the CPU 11, and the parameter is changed depending on an operation amount according to periodic processing of the rotation operator (described later).

The selection button 17*b* receives an operation for selecting a parameter assigned to the rotation operator 17*a* among the plurality of kinds of parameters. When the operation to the selection button 17*b* is performed, the kind of the parameter selected is input to the CPU 11, and the parameter as a target for adjusting is switched by the CPU 11 according to the periodic processing of the rotation operator. In the present embodiment, for a parameter as a target for adjusting, for example, it is possible to designate volume, tempo, rhythm pattern, selection of rhythm, tone, etc. of tone bank, etc., assignment of track number or channel number of a sequencer, effect number indicating a kind of an effect, various kinds of parameters such as a duration of effect and depth of effect, note number indicating a pitch and a sequence of a musical note, number of data storage, etc.

Here, in the present embodiment, when the rotation operator 17*a* is operated, a parameter changes by a change rate according to an angle of rotation (operation amount) from a standard position of the index portion 17*c*. Then, the user determines a parameter by setting a position of the index portion 17*c* of the rotation operator 17*a* back to the standard position with timing of a target value, while the user is viewing the parameter displayed on the display of the output unit 18.

Figure 3A:
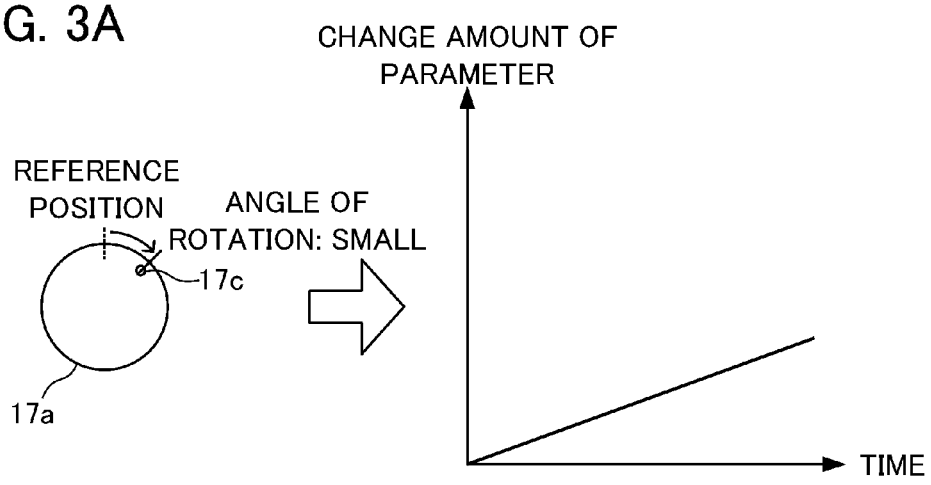
FIG. 3A is a view illustrating a relationship between an operating time of a rotation operator and a change amount of a parameter, and illustrating a case in which the angle of rotation from a standard position is small.
Figure 3B:
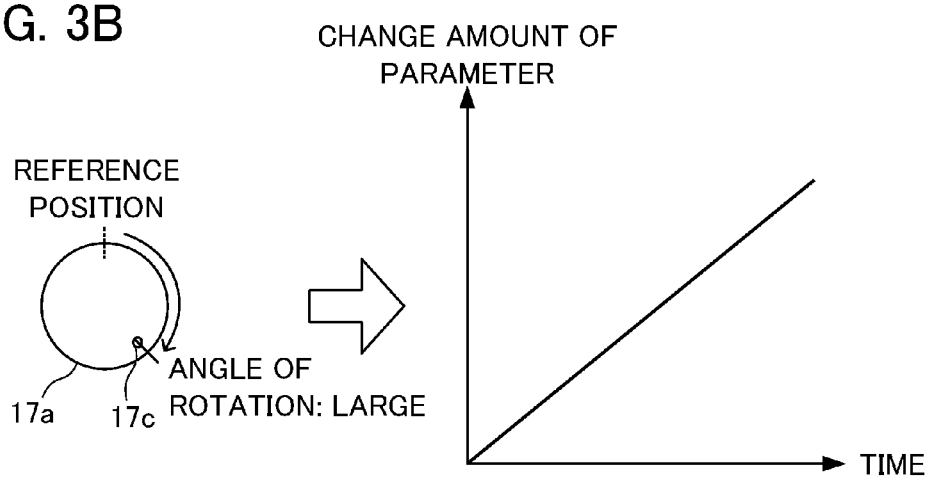
FIG. 3B is a view illustrating a relationship between an operating time of a rotation operator and a change amount of a parameter, and illustrating a case in which the angle of rotation from a standard position is large.

FIGS. 3A and 3B are views illustrating a relationship between the operating time of the rotation operator 17*a* and the change amount of a parameter. FIG. 3A illustrates a case in which the angle of rotation from the standard position is small. FIG. 3B illustrates a case in which the angle of rotation from the standard position is large.

As illustrated in FIG. 3A, in a case in which the angle of rotation from the standard position is small, the parameter changes with a small change rate, and the gradient of the change amount of the parameter with respect to the operating time is small. On the other hand, as illustrated in FIG. 3B, in a case in which the angle of rotation from the standard position is large, the parameter changes with a great change rate, and the gradient of the change amount of the parameter with respect to the operating time is great.

With reference to FIG. 2 again, the output unit 18 is configured with a display, a speaker, etc., and outputs images and sound. For example, the kind, value, etc. of the parameter adjusted by the rotation operator 17*a* is displayed on the display of the output unit 18. Furthermore, a musical sound, etc. to which effect is given is output from the speaker of the output unit 18.

The storage unit 19 is configured with a hard disk, DRAM (Dynamic Random Access Memory) or the like, and stores a filter that realizes an effect, data of rhythm or tempo, etc., and various data used in the musical sound control apparatus 1.

The communication unit 20 controls communication with another apparatus (not illustrated) via a network including the Internet, etc.

A removable medium 31 composed of a magnetic disk, an optical disk, a magnetic optical disk, semiconductor memory or the like is appropriately mounted to the drive 21. A program read from the removable medium 31 by the drive 21 is installed to the storage unit 19 as required. Furthermore, the removable medium 31 can store various data stored in the storage unit 19 in a similar way to the storage unit 19.

Operation

Next, operation of the musical sound control apparatus 1 is explained.

Main Flow

Figure 4:
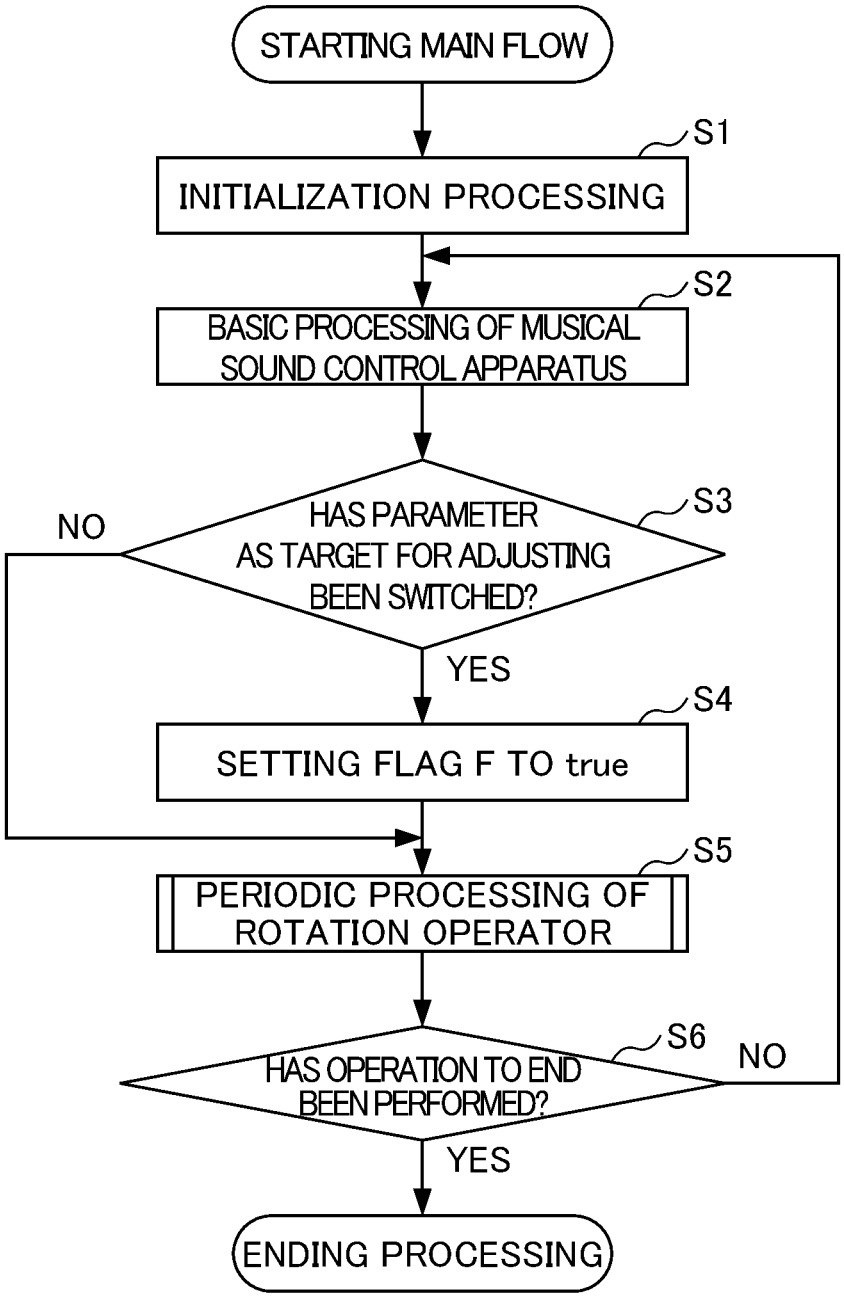
FIG. 4 is a flow chart illustrating the flow of a main flow executed by a CPU.

With reference to FIG. 4, a main flow executed by the CPU 11 is explained.

FIG. 4 is a flow chart illustrating the flow of a main flow executed by the CPU 11.

The main flow is started when the power source of the musical sound control apparatus 1 is turned ON. It should be noted that, in the following descriptions, a case of the rotation operator 17*a* being operated is explained as an example.

In Step S1, the CPU 11 performs initialization processing of the musical sound control apparatus 1. More specifically, the CPU 11 initializes the RAM 13, the external interface unit 16, etc.

In Step S2, the CPU 11 executes basic processing of the musical sound control apparatus 1 (processing including checking various switches, controlling sound, recording a musical sound, etc.).

In Step S3, the CPU 11 judges whether a parameter as a target for adjusting has been switched. More specifically, the CPU 11 judges whether a parameter assigned to the rotation operator 17*a*, etc. has been switched by the selection button 17*b* being operated.

In a case of the parameter as a target for adjusting having been switched, it is judged as YES in Step S3, and the processing advances to Step S4.

On the other hand, in a case of the parameter as a target for adjusting not having been switched, it is judged as NO in Step S3, and the processing advances to Step S5.

In Step S4, the CPU 11 set a flag F to "true".

Here, the flag F is a flag indicating whether to execute control not to change a value of the parameter in response to an operation in a direction of the standard position of the index portion 17*c* of the rotation operator 17*a* (hereinafter, referred to as "parameter fixed control") in a case in which the parameter as a target for adjusting was switched. In a case of the flag F being "true", the parameter fixed control is executed, and in a case of the flag F being "false", the parameter fixed control is not executed, and control for normal parameter adjustment (control of parameter adjustment according to an operation amount of the rotation operator 17*a*) is executed. It should be noted that the parameter fixed control is executed in a case in which the position of the index portion 17*c* of the rotation operator 17*a* is retained at a position other than the standard position.

Figure 5:
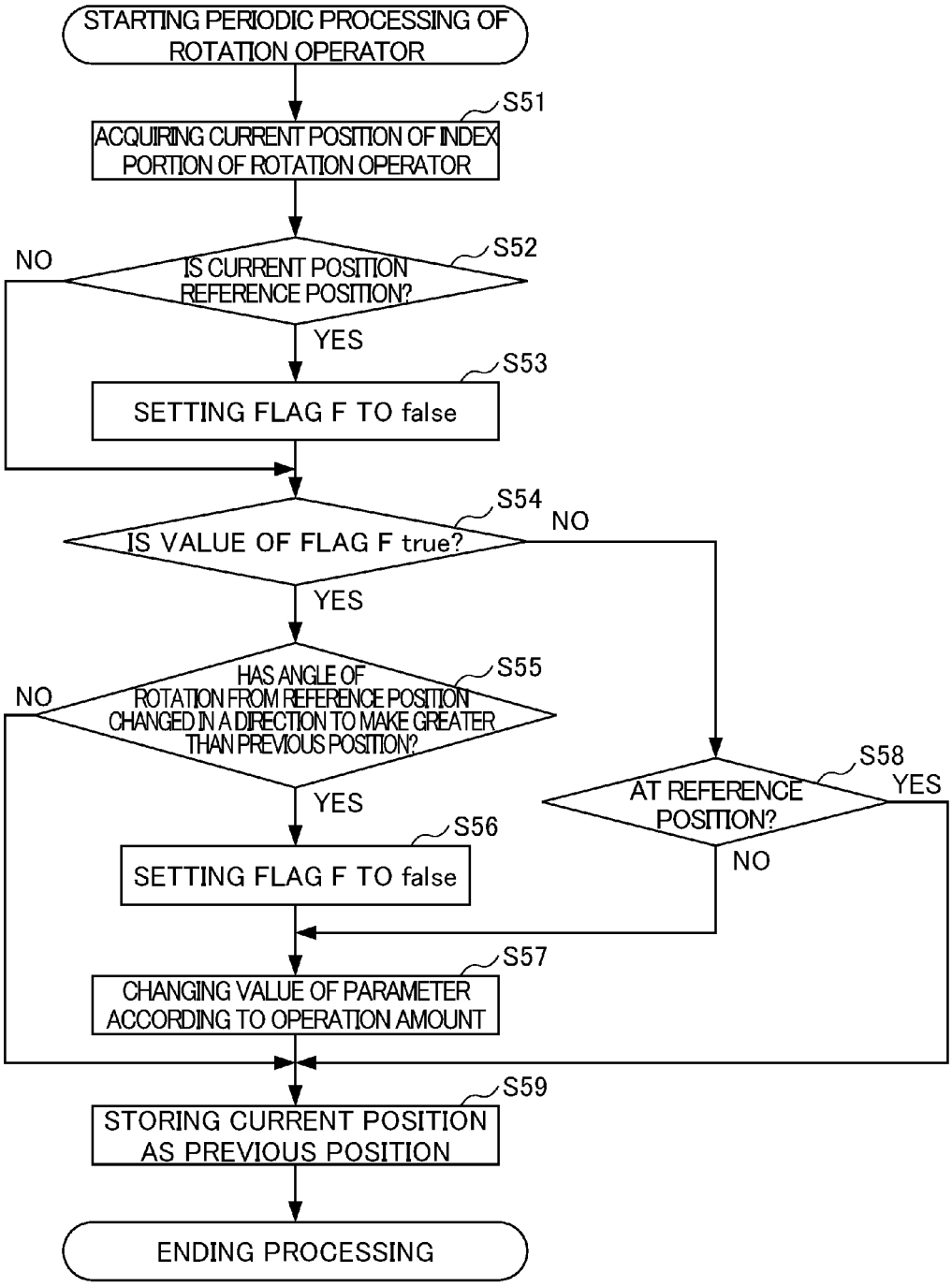
FIG. 5 is a flow chart illustrating the flow of periodic processing of a rotation operator.

In Step S5, the CPU 11 executes the periodic processing of the rotation operator (refer to FIG. 5).

In Step S6, the CPU 11 judges whether an operation to end the operation of the musical sound control apparatus 1 was performed. For example, the CPU 11 judges whether an operation to turn OFF the power source of the musical sound control apparatus 1 was performed.

In a case in which the operation to turn OFF the musical sound control apparatus 1 has not been performed, the processing returns to Step S2.

On the other hand, in a case in which the operation to turn OFF the musical sound control apparatus 1 has been performed, the main flow ends.

Periodic Processing of Rotation Operator

Next, periodic processing of a rotation operator executed in Step S5 of the main flow is explained.

FIG. 5 is a flow chart illustrating the flow of periodic processing of a rotation operator.

In Step S51, the CPU 11 acquires a current position (an angle of rotation from the standard position) of the index portion 17*c* of the rotation operator 17*a*.

In Step S52, the CPU 11 judges whether a current position of the index portion 17*c* of the rotation operator 17*a* is the standard position.

In a case in which the current position of the index portion 17*c* of the rotation operator 17*a* is the standard position, it is judged as YES in Step S52 and the processing advances to Step S53.

On the other hand, in a case in which the current position of the index portion 17*c* of the rotation operator 17*a* is not the standard position, it is judged as NO in Step S52, and the processing advances to Step S54.

In Step S53, the CPU 11 sets the flag F to "false". In other words, in this case, since the current position of the index portion 17*c* of the rotation operator 17*a* is the standard position, it is set as a state not performing the parameter fixed control.

In Step S54, the CPU 11 judges whether the value of the flag F is "true".

In a case in which the value of the flag F is "true", it is judged as YES in Step S54, and the processing advances to Step S55.

On the other hand, in a case of the value of the flag F being "false", it is judged as NO in Step S54, and the processing advances to Step S58.

In Step S55, the CPU 11 judges whether the angle of rotation from the standard position of the index portion 17*c* of the rotation operator 17*a* has changed in a direction to make greater than the previous position (the angle of rotation at the time previously detected).

In a case in which the angle of rotation from the standard position of the index portion 17*c* of the rotation operator 17*a* has changed in a direction to make greater than the previous position, it is judged as YES in Step S55, and the processing advances to Step S56.

On the other hand, in a case in which the angle of rotation from the standard position of the index portion 17*c* of the rotation operator 17*a* has not changed in a direction to make greater than the previous position, it is judged as NO in Step S55, and the processing advances to Step S59.

In Step S56, the CPU 11 sets the flag F to "false".

In Step S57, the CPU 11 changes the value of a parameter according to the position (operation amount) of the index portion 17*c* of the rotation operator 17*a*.

In Step S58, the CPU 11 judges whether the index portion 17*c* of the rotation operator 17*a* is positioned at a standard position.

In a case in which the index portion 17*c* of the rotation operator 17*a* is positioned at the standard position, it is judged as YES in Step S58, and the processing advances to Step S59.

On the other hand, in a case in which the index portion 17*c* of the rotation operator 17*a* is not positioned at the standard position, it is judged as NO in Step S58, and the processing advances to Step S57.

In Step S59, the CPU 11 stores the current position of the index portion 17*c* of the rotation operator 17*a* as a previous position.

After Step S59, the processing returns to the main flow.

As a result of such processing being performed, with normal operation (in a case of the parameter as a target for adjusting has not been switched) of the musical sound control apparatus 1, when the index portion 17*c* of the rotation operator 17*a* is positioned at the standard position, the value of the parameter does not change. Then, when the position of the index portion 17*c* of the rotation operator 17*a* has changed from the standard position, the value of the parameter continuously changes. At this time, as explained in FIG. 3, the change rate of the value of the parameter changes according to the angle of rotation from the standard position of the rotation operator 17*a*.

Furthermore, with the musical sound control apparatus 1, in a case of the parameter as a target for adjusting has been switched, the value of the parameter as a target for adjusting before being switched is made to stop changing. Furthermore, in a case of the parameter as a target for adjusting having been switched and the position of the index portion 17*c* of the rotation operator 17*a* being other than the standard position, the value of the parameter as a target for adjusting after being switched is controlled so as not to change (parameter fixed control) regardless of the position of the index portion 17*c* of the rotation operator 17*a* not being the standard position. If the value of the parameter promptly changed immediately after the parameter as a target for adjusting having been switched, there is a possibility that a rapid change of a value of the parameter, etc. that a user did not intend may occur. Similarly, if the parameter as a target for adjusting has been switched and the rotation operator 17*a* is operated in the direction of the standard position, the value of the parameter as a target for adjusting after being switched is controlled so as not to change (parameter fixed control). This is because it can be interpreted that the user's intention can include either changing the value of the parameter or returning the position of the index portion 17*c* of the rotation operator 17*a* to the standard position.

On the other hand, with the musical sound control apparatus 1, if the rotation operator 17*a* has been operated in a direction opposite to a direction to the standard position after the parameter as a target for adjusting having been switched, the value of the parameter as a target for adjusting after being switched is started to be controlled so as to change again. This is because the user's intention is considered to be in changing the value of the parameter based on the performance of "operating the rotation operator 17*a* in a direction opposite to a direction to the standard position".

Furthermore, if the index portion 17*c* of the rotation operator 17*a* is operated in a direction opposite to a direction to the standard position, while being operated in a direction to the standard position, the musical sound control apparatus 1 starts to change the value of the parameter at that time.

Once the value of the parameter starts changing or the rotation operator 17*a* returns to the standard position, the musical sound control apparatus 1 returns to normal operation thereafter.

It should be noted that, in the abovementioned embodiment, the parameter operated by the rotation operator 17*a* is explained as changing with a change rate according to the angle of rotation (operation amount) from a standard position of the rotation operator 17*a*. On the other hand, a parameter operated by the rotation operator 17*a* may be configured so that a value according to the angle of rotation (operation amount) from a standard position of the rotation operator 17*a* is set. In other words, depending on a kind of parameter as a target for adjusting, it is possible for the CPU 11 to execute processing by switching between the control that changes the parameter with a change rate according to the angle of rotation (operation amount) from a standard position of the rotation operator 17*a* and the control that sets a value according to the angle of rotation (operation amount) from a standard position of the rotation operator 17*a*.

With such a configuration, when switching a target for adjusting to a parameter that changes with a change rate according to the angle of rotation from the standard position of the rotation operator 17*a*, after adjusting a parameter for which the value is set according to the angle of rotation from the standard position of the rotation operator 17*a*, for example, it is possible to prevent a situation where the parameter after being switched changes before returning the rotation operator 17*a* to the standard position.

In such a case, it may be configured so as to switch between a mode that changes the parameter with a change rate according to the angle of rotation (operation amount) from the standard position of the rotation operator 17*a* and a mode in which a value is set according to the angle of rotation (operation amount) from the standard position of the rotation operator 17*a*, automatically depending on the parameter, when actually changing the parameter as the target for adjusting by means of the selection button 17*b*, for example, or, alternatively, it may be configured so that a user explicitly performs changing of the parameter in either mode using another button, etc. (not illustrated).

Furthermore, although an example is given in the aforementioned embodiment in which the center position of the rotation range is the standard position of the rotation operator 17*a*, the present invention is not limited thereto. For example, it is possible to set the standard position of the rotation operator 17*a* to the upper limit or the lower limit of the rotation range. In this case, the value of the parameter makes a change of simply increasing or decreasing according to an operation of the rotation operator 17*a*.

Furthermore, although the case of applying the present invention to the rotation operator 17*a* is given as an example in the abovementioned embodiment, the present invention is not limited thereto. For example, it may be configured so as to apply the present invention to an operator in another form such as a slider, etc.

Furthermore, although the case of changing the value of the parameter with a change rate according to the angle of rotation (operation amount) from the standard position of the rotation operator 17*a* is given as an example in the abovementioned embodiment, the present invention is not limited thereto. For example, it may be configured so that the change rate of the value of the parameter is set to be constant regardless of the angle of rotation from the standard position.

Furthermore, it is explained in the abovementioned embodiment that the value of the parameter changes when operating the index portion 17*c* of the rotation operator 17*a* in a direction opposite to a direction of the standard position when the parameter as a target for adjusting is switched. At this time, it is possible for the change rate of the value of the parameter to be determined by the absolute value of the angle of rotation from the standard position of the rotation operator 17*a*. Furthermore, it is also possible to set a current angle of rotation as a minimum change rate and a limit (an upper limit or a lower limit) of a rotation range in a direction that is the same as a direction of the current position with respect to the standard position as a maximum change rate, and then cause the change rate of the parameter therebetween to change continuously.

Furthermore, in the abovementioned embodiment, it is possible to establish the configuration of the rotation operator 17*a* so as to include a center click function (a function of enhancing resistance to rotation at the standard position), a result of which it is possible to configure so as to facilitate stopping the rotation at the standard position.

Furthermore, in the abovementioned embodiment, when judging the standard position, it is possible to allow for so called "play" by assuming a range having a certain width including the standard position as the standard position, and it is possible to perform stopping the rotation operator 17*a* at the standard position easily.

Furthermore, in the abovementioned embodiment, it may be configured so as to change the value of a parameter according to an operation rate of the rotation operator 17*a*. It may be configured so as to accelerate a change rate of the parameter when the operation rate is fast, and decelerate the change rate of the parameter when the operation rate is slow.

Furthermore, for example, in the case of returning the rotation operator 17*a* to the standard position in order to determine the value of the parameter, it may be configured so as to decelerate the change in the value of the parameter when slowly returning the rotation operator 17*a* to the standard position. In this case, it is possible to prevent the value of the parameter from changing rapidly before returning to the standard position.

The musical sound control apparatus 1 configured as above includes the rotation operator 17*a* and the CPU 11.

The rotation operator 17*a* can move within a predetermined operation range including a standard position.

The CPU 11 executes control to change the value of a parameter assigned to the rotation operator 17*a* according to an operated position of an index portion 17*c* of the rotation operator 17*a* based on the standard position, and executes control not to change the value of the parameter in response to an operation of moving the rotation operator 17*a* in the direction of the standard position, in a case in which the index portion 17*c* of the rotation operator 17*a* is positioned at a position other than the standard position of the operation range when having changed the parameter assigned to the rotation operator 17*a* to another parameter.

With such a configuration, when switching the parameter assigned to the rotation operator 17*a* that can move within the predetermined operation range including the standard position, the value of the parameter does not change in a case of the index portion 17*c* of the rotation operator 17*a* returning to the standard position.

For this reason, it is possible to suppress a situation in which the value of the parameter after being switched changes rapidly.

Therefore, it is possible to realize a function of appropriately operating a plurality of kinds of parameters by way of a common operator at low cost.

Furthermore, the CPU 11 assigns any of the plurality of kinds of parameters to the rotation operator 17*a*.

Furthermore, when changing the parameter assigned to the rotation operator 17*a* to another parameter, in a case in which the rotation operator 17*a* is positioned at a position other than the standard position in the operation range, the CPU 11 executes control not to change the value of the parameter in response to an operation moving the index portion 17*c* of the rotation operator 17*a* to the direction of the standard position.

For this reason, it is possible to suppress a situation in which the value of the parameter changes rapidly after switching the plurality of kinds of parameters.

Therefore, it is possible to realize a function of operating the plurality of kinds of parameters by way of a common operator appropriately at low cost.

Furthermore, in a case in which the rotation operator 17*a* is operated in a direction opposite to the direction to the standard position when executing control not to change the value of a parameter, the CPU 11 changes the parameter according to the operated position of the index portion 17*c* of the rotation operator 17*a*.

With such a configuration, it is possible to perform adjusting of the parameter by properly reflecting a user's intention to adjust the parameter.

Furthermore, the CPU 11 executes at least either of control to cause an operated position of the index portion 17*c* of the rotation operator 17*a* to correspond to a setting value of the parameter, or control to cause the operated position of the rotation operator 17*a* to correspond to a change rate of the parameter.

With such a configuration, it is possible to appropriately adjust the parameter even in a situation in which a case of the value of the parameter corresponding to the operated position of the index portion 17*c* of the rotation operator 17*a* as well as a case of the change rate of the parameter corresponding to the operation position of the index portion 17*c* of the rotation operator 17*a* coexist.

Furthermore, in a case in which, when any of the parameters is assigned to the rotation operator 17*a*, the index portion 17*c* of the rotation operator 17*a* is positioned at a position other than the standard position within the operation range, and the rotation operator 17*a* is operated in a direction opposite to the direction of the standard position, it is possible for the CPU 11 to change the parameter according to the operated position from the reference positon of the rotation operator 17*a*.

With such a configuration, when the rotation operator 17*a* is operated in a direction opposite to the direction of the standard position, it is possible to set the value of a parameter using the absolute value of the operated position of the index portion 17*c* of the rotation operator 17*a*.

Furthermore, in a case in which, when any of the parameters is assigned to the rotation operator 17*a*, the index portion 17*c* of the rotation operator 17*a* is positioned at a position other than the standard position within the operation range, and the index portion 17*c* of the rotation operator 17*a* is operated in a direction opposite to the direction of the standard position, it may be configured so that the CPU 11 changes the parameter according to the operated position from a position of the rotation operator 17*a* at the time of the parameter being assigned.

With such a configuration, when the index portion 17*c* of the rotation operator 17*a* is operated in a direction opposite to the direction of the standard position, it is possible to set the value of the parameter using a change from a current position of the index portion 17*c* of the rotation operator 17*a*.

Furthermore, in a case in which the index portion 17*c* of the rotation operator 17*a* is positioned within a range set from the standard position, the CPU 11 judges that the index portion 17*c* of the rotation operator 17*a* is positioned at the standard position.

With such a configuration, it is possible to perform stopping of the rotation operator 17*a* at the standard position easily.

Furthermore, an electric musical instrument to which the present invention is applied outputs musical sound controlled by the musical sound control apparatus 1.

Therefore, it is possible to realize a function of appropriately operating a plurality of kinds of parameters by way of a common operator at low cost.

It should be noted that the present invention is not to be limited to the aforementioned embodiment, and that modifications, improvements, etc. within a scope that can achieve the object of the present invention are also included in the present invention.

For example, the present invention can also be applied to a case of selecting a character upon inputting characters using a cursor such as "A→B→C→ . . . ", for example, by operating the rotation operator 17*a* described in the abovementioned embodiment.

In the abovementioned embodiment, although an electronic device in which functions of a so-called turntable or a DJ mixer, for example, are realized by way of electronic processing is described as an example for the musical sound control apparatus 1 to which the present invention is applied, the present invention is not particularly limited thereto.

For example, the present invention can be applied to any electronic device in general having a function of adjusting a parameter. More specifically, for example, the present invention can be applied to an electric musical instrument such as a keyboard, an electric guitar, a mixer, an effector and an equalizer.

The processing sequence described above can be executed by hardware, and can also be executed by software.

In other words, the abovementioned hardware configuration is merely an illustrative example, and the present invention is not particularly limited thereto. More specifically, the types of functional blocks employed to realize the above-described functions are not particularly limited to the example shown in FIG. 3, so long as the wrist terminal 1 can be provided with the functions enabling the aforementioned processing sequence to be executed in its entirety.

A single functional block may be configured by a single piece of hardware, a single installation of software, or any combination thereof.

In a case in which the processing sequence is executed by software, a program configuring the software is installed from a network or a storage medium into a computer or the like.

The computer may be a computer embedded in dedicated hardware. Alternatively, the computer may be a computer capable of executing various functions by installing various programs, e.g., a general-purpose personal computer.

The storage medium containing such a program can not only be constituted by the removable medium 31 shown in FIG. 2 distributed separately from the device main body for supplying the program to a user, but also can be constituted by a storage medium or the like supplied to the user in a state incorporated in the device main body in advance. The removable medium 31 is composed of, for example, a magnetic disk (including a floppy disk), an optical disk, a magnetic optical disk, or the like. The optical disk is composed of, for example, a CD-ROM (Compact Disk-Read Only Memory), a DVD (Digital Versatile Disk), Blu-ray (Registered Trade Mark) or the like. The magnetic optical disk is composed of an MD (Mini-Disk) or the like. The storage medium supplied to the user in a state incorporated in the device main body in advance may include, for example, the ROM 12 shown in FIG. 2 in which the program is recorded or a hard disk, etc. included in the storage unit 19 in FIG. 2.

It should be noted that, in the present specification, the steps describing the program recorded in the storage medium include not only the processing executed in a time series following this order, but also processing executed in parallel or individually, which is not necessarily executed in a time series.

The embodiments of the present invention described so far are only illustrative and are not to limit the technical scope of the present invention. Various other embodiments can be applied to the present invention. Additionally, these embodiments can be changed in any way by means of omission or replacement without departing from the substance of the present invention. These embodiments or modifications thereof are within the scope and the substance of the invention described in this specification, and within the invention recited in the scope of claims and within a scope equivalent to this invention.

EXPLANATION OF REFERENCE NUMERALS

1 musical sound control apparatus
11 CPU
12 ROM
13 RAM
14 bus
15 input/output interface
16 external interface unit
17 input unit
17*a* rotation operator
17*b* selection button
17*c* index portion
18 output unit
19 storage unit
20 communication unit
21 drive
31 removable medium

What is claimed is:

1. A musical sound control apparatus, comprising:

an operator which has an index portion and which changes values of a plurality of kinds of parameters by moving a position of the index portion;

a parameter selection unit which selects a parameter assigned to the operator from among the plurality of kinds of parameters; and a processor which executes processing of (i) changing a value of the parameter selected by the parameter selection unit according to an operated position to which the index portion was moved from a standard position, and (ii) not changing a value of a second parameter assigned to the position indicated by the index portion, when changing an assignment to the operator from a first parameter among the plurality of kinds of parameters to the second parameter when the second parameter is selected by the parameter selection unit in a state in which the position indicated by the index portion is not the standard position, so as to suppress a situation in which a value of the second parameter changes rapidly after changing the assignment to the operator from the first parameter to the second parameter selected by the parameter selection unit.

2. The musical sound control apparatus according to claim 1, wherein the processor further executes processing of, in a case in which the index portion is moved in a direction towards the standard position when changing the assignment to the operator from the first parameter among the plurality of kinds of parameters to the second parameter selected by the parameter selection unit in the state in which the position indicated by the index portion is not the standard position, setting the value of the assigned second parameter to a value which does not correspond to the position indicated by the index portion.

3. The musical sound control apparatus according to claim 1, wherein, in a case in which the index portion is operated in a direction opposite to a direction of the standard position while the processor is executing the processing of not changing the value of the second parameter, the processor stops executing the processing of not changing the value of the second parameter and executes processing of changing the second parameter according to an operated position of the index portion.

4. The musical sound control apparatus according to claim 1, further comprising a parameter assignment unit that assigns any of the plurality of kinds of parameters to the operator.

5. The musical sound control apparatus according to claim 1, wherein the processor executes at least one of (i) control to cause the operated position to correspond to a setting value of the parameter and (ii) control to cause an operated position of the index portion to correspond to a change rate of the parameter.

6. The musical sound control apparatus according to claim 1, wherein, in a case in which the index portion is positioned at the standard position, the processor judges that the index portion is positioned at the standard position and executes control not to change a value of the kind of parameter.

7. The musical sound control apparatus according to claim 1, wherein the processor further executes processing of changing the values of the plurality of kinds of parameters according to the operated position to which the index portion was moved from the standard position by an input operation, and when changing the assignment to the operator from the first parameter among the plurality of kinds of parameters to the second parameter selected by the parameter selection unit in the state in which the position indicated by the index portion is not the standard position, executes processing of setting the value of the assigned second parameter to a value which corresponds to the position of the standard position.

8. An electric musical instrument comprising:

the musical sound control apparatus according to claim 1; and a musical sound output unit that outputs a musical sound controlled by the musical sound control apparatus.

9. A musical sound control method executed by a musical sound control apparatus including an operator which has an index portion and which changes values of a plurality of kinds of parameters by moving a position of the index portion, the method comprising:

selecting a parameter assigned to the operator from among the plurality of kinds of parameters;

changing a value of the parameter selected in the selecting according to an operated position to which the index portion was moved from a standard position; and not changing a value of a second parameter assigned to the position indicated by the index portion, when changing an assignment to the operator from a first parameter among the plurality of kinds of parameters to the second parameter when the second parameter is selected in the selecting in a state in which the position indicated by the index portion is not the standard position, so as to suppress a situation in which a value of the second parameter changes rapidly after changing the assignment to the operator from the first parameter to the second parameter selected in the selecting.

10. The musical sound control method according to claim 9, further comprising:

in a case in which the index portion is moved in a direction towards the standard position when changing the assignment to the operator from the first parameter among the plurality of kinds of parameters to the second parameter selected in the selecting in the state in which the position indicated by the index portion is not the standard position, setting the value of the assigned second parameter to a value which does not correspond to the position indicated by the index portion.

11. The musical sound control method according to claim 9, further comprising:

in a case in which the index portion is operated in a direction opposite to a direction of the standard position while executing the step of not changing the value of the second parameter stopping the step of not changing the value of the second parameter and changing the second parameter according to an operated position of the index portion.

12. A non-transitory computer-readable storage medium having a program stored thereon that is executable by a musical sound control apparatus including an operator which has an index portion and which changes values of a plurality of kinds of parameters by moving a position of the index portion, the program being executable to control the apparatus to execute processes comprising:

a process of selecting a parameter assigned to the operator from among the plurality of kinds of parameters;

a process of changing a value of the parameter selected in the selecting according to an operated position to which the index portion was moved from a standard position; and a process of not changing a value of a second parameter assigned to the position indicated by the index portion, when changing an assignment to the operator from a first parameter among the plurality of kinds of parameters to the second parameter when the second parameter is selected in the process of selecting in a state in which the position indicated by the index portion is not the standard position, so as to suppress a situation in which a value of the second parameter changes rapidly after changing the assignment to the operator from the first parameter to the second parameter selected in the selecting.

13. The non-transitory computer-readable storage medium according to claim 12, the program being executable to control the apparatus to further execute:

in a case in which the index portion is moved in a direction towards the standard position when changing the assignment to the operator from the first parameter among the plurality of kinds of parameters to the second parameter selected in the process of selecting in the state in which the position indicated by the index portion is not the standard position, a process of setting the value of the assigned second parameter to a value which does not correspond to the position indicated by the index portion.

14. The non-transitory computer-readable storage medium according to claim 12, the program being executable to control the apparatus to further execute:

in a case in which the index portion is operated in a direction opposite to a direction of the standard position while executing the process of not changing the value of the second parameter stopping the process of not changing the value of the second parameter and changing the second parameter according to an operated position of the index portion.

* * * * *